United States Patent [19]

Della Rovere

[11] 4,206,919

[45] * Jun. 10, 1980

[54] REUSABLE TARGET PIGEON WITH UNIVERSAL WITNESS DISK

[76] Inventor: Ludovico L. Della Rovere, Avenida Paez Quinta Ismenia, El Paraiso-Caracas, Venezuela

[ * ] Notice: The portion of the term of this patent subsequent to Jan. 9, 1996, has been disclaimed.

[21] Appl. No.: 921,006

[22] Filed: Jun. 30, 1978

Related U.S. Application Data

[63] Continuation-in-part of Ser. No. 762,019, Jan. 24, 1977, Pat. No. 4,133,532, and Ser. No. 882,907, Mar. 1, 1978, and Ser. No. 892,921, Apr. 3, 1978.

[51] Int. Cl.[2] ..... F41J 9/16

[52] U.S. Cl. ..... 273/364; 273/365

[58] Field of Search ..... 273/105.4, 105.5, 127 A; 46/82, 83, 84, 85; 124/36, 43, 47

[56] References Cited

U.S. PATENT DOCUMENTS

| | | | |
|---|---|---|---|
| 3,176,988 | 4/1965 | Ferdinando | 273/105.4 |
| 4,077,384 | 3/1978 | Montefeltro | 273/105.4 |
| 4,133,532 | 1/1979 | Rovere | 273/105.4 |

*Primary Examiner*—George J. Marlo

*Attorney, Agent, or Firm*—Karl F. Ross

[57] ABSTRACT

A target pigeon has a body part in turn having a generally flat web formed with a central throughgoing hole and a pair of offset drive holes, and a pair of vanes extending diametrically opposite each other propeller-fashion from the ends of the web. Outwardly open recesses on circularly arcuate ridges on the ends of the webs receive inwardly projective teeth on the lower edge of a cup-shaped and axially symmetrical witness cap. The sides of the witness cap are fully exposed to both sides of the web.

12 Claims, 7 Drawing Figures

REUSABLE TARGET PIGEON WITH UNIVERSAL WITNESS DISK

CROSS-REFERENCE TO RELATED APPLICATION

This is a continuation-in-part of my copending patent applications 762,019 (now U.S. Pat. No. 4,133,532), 882,907, and 892,921 filed Jan. 24, 1977, Mar. 1, 1978, and Apr. 3, 1978, respectively.

FIELD OF THE INVENTION

The present invention relates to a target pigeon. More particularly this invention concerns such a pigeon which when rotated at high speed and released will propel itself through the air so as to provide a lifelike substitute for live-bird shooting.

BACKGROUND OF THE INVENTION

A target pigeon of the so-called Pro ZZ type and a launcher therefor of the Montefeltro 75 type are known from commonly owned U.S. Pat. No. 4,077,384 issued Mar. 7, 1978 and filed June 3, 1976 as a continuation-in-part of abandoned application 604,069 filed Aug. 12, 1975, and from commonly owned and copending U.S. Patent application No. 762,019, filed Jan. 24, 1977 (now U.S. Pat. No. 4,133,532). In addition, commonly owned U.S. Patent application Nos. 892,921 and 892,922, both filed Apr. 3, 1978 disclose a so-called Universal target pigeon and a launcher therefor.

The target system described in these applications and patents, all of whose disclosures are herewith incorporated, represent a considerable advance over the prior art. Nonetheless, several disadvantages remain.

In particular, the reassembly of the target pigeon of the Pro ZZ type is normally relatively difficult. The small feet formed on the witness cap must be carefully aligned with the respective notches formed on the wing of the propeller part, and the device must be carefully fitted together in order to assemble it. When a target pigeon is to be reused this therefore increases the operating costs of an installation employing such reusable target pigeons. At the same time any errors in reassembly will normally appear when the target pigeon is rotated at high speed immediately prior to launching, causing a "no-bird" or misfiring that requires the shooter to wait while the prematurely separated target pigeon is replaced with another on the launcher.

Another disadvantage of these systems is that even in the reusable pigeon the relatively narrow ring surrounding the witness disk to either side of the web represents a very fragile part of the assembly. Thus even when made of a relatively heavy-duty material, such as the polycarbonate sold under the trade name Lexan, a direct hit on this ring will often permanently damage the otherwise extremely rugged target pigeon.

Finally, a disadvantage of these systems is that the two parts of the target pigeon do not always separate when impacted. This most frequently occurs when a pellet strikes the ring of the body part of the target pigeon and is deflected thereby without impacting the witness disk directly. The result is no score for the shooter, who in reality has struck the target. Obviously this is vexatious for a casual shooter and intolerable during serious shooting competition.

OBJECTS OF THE INVENTION

It is therefore an object of the present invention to provide an improved target pigeon.

Another object is to improve on principles set forth in the above-cited copending application.

A further object is to provide a target pigeon which can easily be assembled for reuse.

Yet a further object is to provide such a target pigeon which separates readily when impacted, and which has a very long service life.

SUMMARY OF THE INVENTION

These objects are attained according to the instant invention in a target pigeon whose body part has a generally flat web formed with a central throughgoing hole and having a pair of diametrically opposite ends from each of which extends a respective vane, these vanes being tipped propeller-fashion relative to each other. The target pigeon also has a cup-shaped witness cap, in turn having a substantially circular rim centered on a cap axis and having an axially directed end engageable with the web at the ends thereof, and fully exposed at arcuate sides or sections diametrically flanking the web. An end plate extends across and closes this rim at the opposite axial end thereof. Means is provided including interengaging formations on the ends of the web and on the rim for releasably securing the body part and witness cap together with the web and cap axes aligned and the one end of the rim bearing on the web at the ends thereof. This means allows for freeing of the cap from the ring when the cap is impacted.

In accordance with the instant invention the cap is symmetrical about the plane of the cap axis and the interengaging formations include radially inwardly extending teeth on the opposite end of the cap rim that are engageable in radially outwardly open recesses on the web. The recesses are each formed in a respective one of a pair of circularly arcuate ridges each formed at a respective end of the web and bearing radially on the opposite side of the rim at the respective lugs or tabs.

This system therefore leaves large sections of the underside of the witness cap exposed and does away with the relatively flimsy structure normally provided at this location. This structure can be eliminated due to the novel holding means according to this invention which insures excellent retention of the cap on the witness part during rotation and launching thereof, yet which nonetheless insures separation of the two parts from each other when impacted.

Furthermore according to this invention the symmetrical cap can be easily snapped in place on the body part. Feet are formed on the end of the cap part that engage in holes on the body part to link the two rotationally together and to prevent deformation of the cap part when impacted from pinching it on the holding and centering ridges. Instead the feet insure that when the cap is impacted it will separate from the body. Both parts are made of a very durable synthetic resin so that the target pigeon according to the instant invention can be shot a great number of times before it is likely to be so badly damaged as to no longer be reusable.

According to the instant invention in addition to the above-mentioned central hole the web is formed with a pair of diametrically opposite offset holes. The central hole and the offset holes are dimensioned and positioned so that the unit can be fit directly over a standard launch head, of the type shown in the above-mentioned U.S. Pat. No. 4,077,384 in FIGS. 2 and 2A. The web is formed similarly to the web described and shown in my copending applications 882,907 and 762,019. The witness disk is similar to that shown in my copending application 892,921.

SPECIFIC DESCRIPTION

Figures 1, 2, 3, 4, 5, 6, 7:
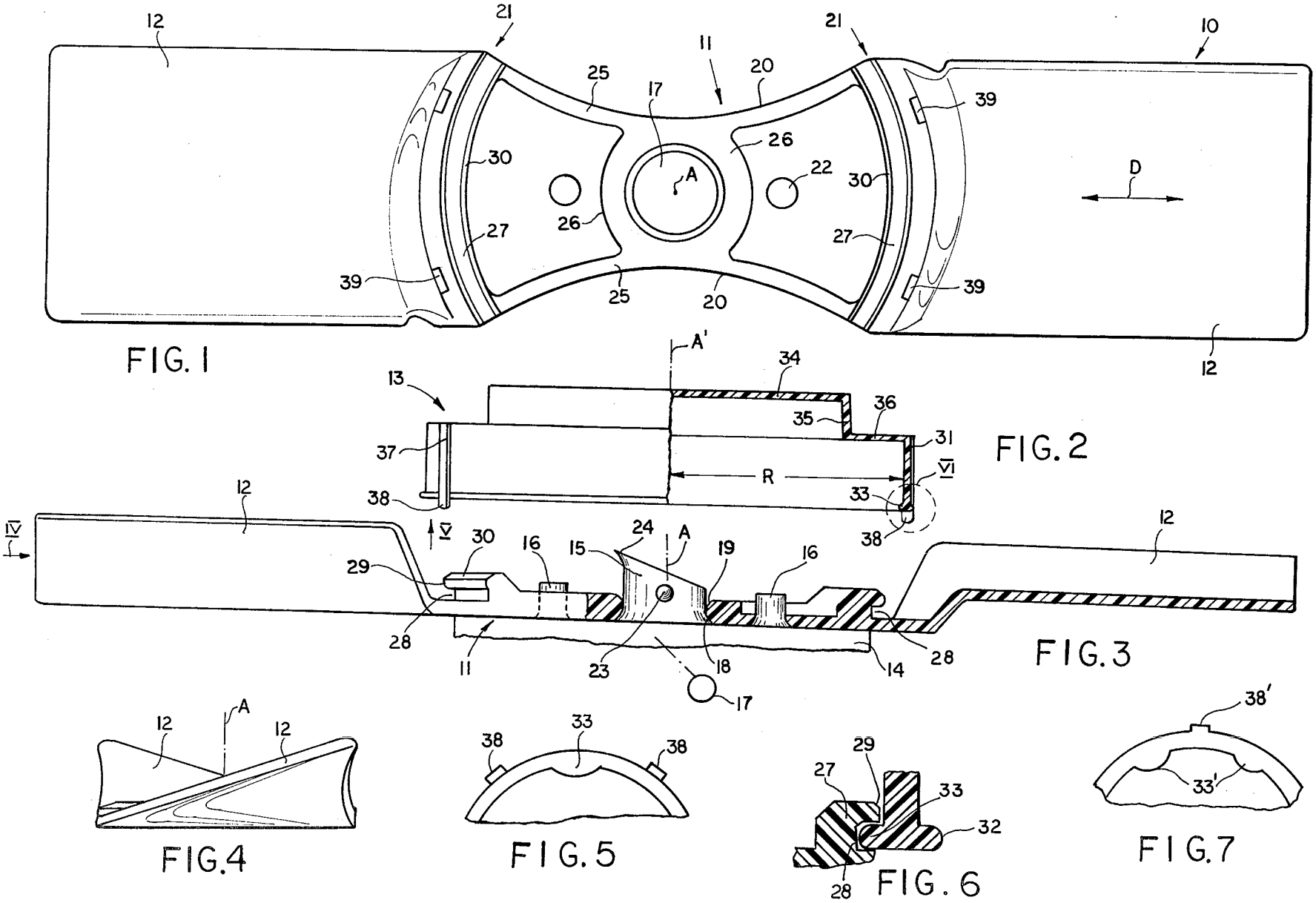
FIG. 1 is a top view of a body part of a target pigeon according to this invention.
FIG. 2 is a partly sectional side view of a witness disk for the target pigeon according to this invention.
FIG. 3 is a side partly sectional view of the body part shown in FIG. 1 mounted on a launch head.
FIG. 4 is an end view of the body part taken in the direction of arrow IV of FIG. 3.
FIG. 5 is a section taken in the direction of arrow V of FIG. 2.
FIG. 6 is a large-scale view of the detail indicated at VI in FIG. 2, with the corresponding portion of the body part.
FIG. 7 is a view similar to FIG. 5 showing another configuration of the cap part.

As shown in FIGS. 1–4, a target pigeon according to this invention basically comprises a body part 10 subdivided into a web 11 and a pair of vanes 12, and a witness disk or cap 13. The arrangement is adapted to be mounted on a launch head 14 having a deflecting beak 15 and a pair of drive pins 16 rotatable by means of a motor 17 and substantially identical to the structure shown in FIGS. 2 and 2A of my U.S. Pat. No. 4,077,384. Both of the parts 10 and 13 are made of a rugged synthetic resin, a polycarbonate such as Lexan being ideal. Other materials having good elasticity and high impact resistance are also usable in accordance with this invention.

The web 11 is elongated in the direction D of elongation of the body part 10 and is centered on an axis A through a central hole 17 having a chamfered lower portion 18 lying at a 45° angle to the axis A and a quarter-circular section upper portion 19. The web has a pair of circularly arcuate side edges 20 which terminate at the ends 21 of the web 11, and which are centered on axes lying in a plane including the axis A and perpendicular to the direction D. In addition this web is formed to either side of the central hole 17 with smaller diameter drive holes 22 adapted to receive the drive pins 16. Thus it is possible to fit this web 11 over the drive head 14 of a standard target-pigeon launcher. When rotated at high speed the launch tip 15 centers the body part 10, the drive pins 16 transmit the rotation of the head 14 to the body part 10, and radially retractable balls 23 in the tip 15 hold this body part 10 axially in place. For launching, a fork pushes against the web 11 with simultaneous radial retraction of the balls 23 so that the body part 10 is pressed axially off the tip 15 and is laterally deflected by a beak 24 thereof as described in my above-cited patent and applications.

The vanes 12 are tipped propeller-fashion relative to each other as shown in FIG. 4 and extend diametrically opposite each other in the direction D.

On its upper face the web 11 is formed with a pair of arcuate reinforcing ridges 25 extending along the edges 20 and around the hole 17 at 26. In addition along each of the outer ends 21 there is formed a ridge 27. Each ridge 27 has an upper surface 30 which is higher than but parallel to the upper surfaces of the reinforcing ridges 25 and 26. In addition each ridge 27 is formed with an outwardly open recess or groove 28 and along its upper and outer edge with a chamfer 29.

The cap 13 is cup-shaped, and although it can be of simple cylindrical closed shape is here stepped. Thus this cap 13 has an outer rim 31 whose lower edge is formed with an outwardly directed rounded reinforcing and pellet-deflecting bead 32. Internally the rim 31 is formed with a pair of radially inwardly projecting teeth 33 engageable in the recesses 28. A central circular and flat part 34 is connected via a cylindrical wall portion 35 to an annular and circular flat part 36 connected to the upper edge of the rim 31. The cap is centered on an axis A and the rim 31 has a radius R equal to the radius of the outer surface of the ridges 27. Thus the cap 13 can be snugly fitted over the ridges 27 with limited outward elastic deformation of the rim and snapping of the teeth 33 into the recesses 28. Furthermore the cap 13 is formed to each side of each tooth 33 with an axially extending ridge 37 terminating at its lower end in a small foot 38 that projects downwardly beyond the lower edge of the rim 31 and that is of rounded shape as shown in FIGS. 2 and 5. The body part 10 is correspondingly formed just at each outer end 29 of the web 11 with a pair of rectangular-section throughgoing holes or recesses 39 in which these feet 38 are loosely engageable. It is within the scope of this invention to provide only two such feet 38 and ridges 27, in which case they are aligned with the teeth 33.

When the cap part 13 is fitted to the body part 10 and pressed downwardly on the inclined surfaces 29 of the ridges 27 the rim 31 will be deflected elastically outwardly at each of the teeth 33 until these teeth 33 can snap at each side into the recesses 28, returning the rim 31 to its cylindrical shape. At the same time the feet 38 fit into the holes 39. In this condition the arrangement is held securely together and can by spun at high speed by the launch head 14. Even when released and deflected by the beak tip 24, the two parts 10 and 13 will not separate from each other. Nonetheless, if the cap 13 or body part 10 are impacted in any irregular manner from the outside, the two parts will separate, with the wall 31 deforming elastically to free the teeth 33 from the recesses 28. Once the two parts separate, the relatively light body part 10 will immediately lose most of its momentum and flutter to the ground, and the nonaerodynamic cap part 13 will fall immediately.

The cap part 13 has most of its area exposed outside the edges 20 of the web 11. Since most of the time the target pigeon is flying away from the shooter, this leaves a great deal of the underside of the disk exposed. Any shot from behind which impinges at all on the underside of the disk 13 will assuredly separate it from the body part 10. In those few instances when the target pigeon is not flying away from the shooter, it is normally oriented so that the side walls 35 and 31 are exposed to the shooter. The rounded outer bead 32 will deflect any such side shot to prevent damage to the cap part 13 and to deflect a pellet against the side wall 31. Furthermore, any side shot will push the cap part 13 perpendicular to the axes A and A' to deform it and pull out the feet 38, thereby insuring separation. There is practically no structure in the target pigeon to shield the cap part 13 so that any shot, even a single pellet, will be able to separate the two parts 10 and 13 from each other.

Since the cap 13 is easily deformable, it can be mounted easily on the body part 10. The recesses 28 are formed as slots so that the two parts can fit together in any angular position. This mounting can also be done extremely rapidly and will insure excellent holding. What is more, the elimination of the relatively fragile ring parts normally necessary to center and hold the witness disk on the body part eliminates from the body part the most fragile parts thereof, so that virtually all of the structure thereof is relatively solid and not likely to be damaged in use. The target pigeon according to this invention, therefore, is reusable and will have a much longer service life than any hitherto known target pigeon usable with a standard launch head having a small central beak and drive pins as mentioned above. The attachment formations 28 and 33 can, in particular, be used on the Universal pigeon of my copending application 892,921. Furthermore, the tie used to interconnect the two parts can be used with the pigeon of this invention. Also as shown in FIG. 7 two teeth 33' can be used on each side of the cap 13 flanking a single foot 38'. Of course the cap can have only two teeth and two feet, diametrically aligned, also.

The target pigeon according to the invention, when made of Lexan, has an overall weight of 76.75 g, 51.35 g for the body part 10 and 25.4 g for the disk 13. The body part 10 measures tip-to-tip in the direction D, 275 mm and the vanes 12 are tipped at 17 degrees at their tips to a plane orthogonal to the axis A. The sides 20 have a radius of curvature of 70 mm and the diametral distance between the planes of the two cutouts 30 is 96 mm. The holes 17 and 22 have respective radii of 16.5 mm and 3.5 mm and the holes 22 are on centers spaced apart by 46 mm. The radius of curvature of the outer surfaces of the ridges 27 is 49.9 mm and these ridges have an overall height at their surfaces 30 of 5 mm.

The cap part has an overall height along the axis A' equal to 25 mm and an inside diameter of 103 mm. The drawing is substantially to scale otherwise. Both parts 10 and 13 are made by injection molding and are normally made in different colors for maximum visibility.

I claim:

1. A target pigeon comprising:

a generally flat web formed at a web axis with a central throughgoing hole and having a pair of diametrically opposite ends, said web being of a predetermined maximum width measured in a plane perpendicular to said web axis;

a pair of vanes on said web extending diametrically oppositely from said ends thereof and tipped propeller-fashion to each other;

a cup-shaped witness cap having a substantially circular rim centered on a cap axis and having an axially directed end engageable with said web at said ends thereof and fully exposed at arcuate sections diametrically flanking said web and an opposite axially directed end, and an end plate extending across and closing said rim at said opposite thereof; and means including interengaging formations on said ends of said web and on said rim for releasably securing same together with said axes aligned and said one end of said rim bearing on said web at said ends thereof and for freeing said cap and said ring from each other when said cap is impacted.

2. The target pigeon defined in claim 1 wherein said cap is substantially symmetrical about a plane including said cap axis.

3. The target pigeon defined in claim 2 wherein said interengaging formations include respective inwardly radially projecting teeth on said opposite end of said rim.

4. The target pigeon defined in claim 3 wherein said interengaging formations include at least two angularly spaced and radially open recesses on said ring in which said teeth are engageable.

5. The target pigeon defined in claim 4 wherein said rim is elastically deformable sufficiently to displace said teeth out of said recesses.

6. The target pigeon defined in claim 1 wherein said web is formed with a pair of circularly arcuate axially projecting ridges centered on said web axis and receivable to one radial side of said opposite end of said rim when said cap and said web are secured together.

7. The target pigeon defined in claim 6 wherein said ridge has an outer surface with a radius of curvature substantially equal to half of the diameter of said opposite end of said rim.

8. The target pigeon defined in claim 7 wherein said interengaging formations include radially inwardly projecting teeth on said opposite end and at least two angularly spaced and radially outwardly open recesses on said ridges in which said teeth are receivable.

9. The target pigeon defined in claim 8 wherein said formations include at least one axially projecting foot on said opposite end of said rim and at least one hole on said web in which said foot is engageable.

10. The target pigeon defined in claim 1 wherein said web is formed radially offset from said central hole with a pair of offset holes diametrically opposite each other and of diameters substantially smaller than said central hole.

11. The target pigeon defined in claim 10 wherein said central hole is of a diameter corresponding to the diameter of the deflecting beak of a standard launch head and said offset holes are dimensioned and spaced to receive the drive pins of such a standard head when the beak thereof is received in said central hole.

12. The target pigeon defined in claim 1 wherein said vanes have minimum widths measured in a plane perpendicular to said web axis and transverse to said vanes equal to at least said maximum width of said web.

* * * * *